US012638260B2

(12) United States Patent
Johnson et al.

(10) Patent No.: US 12,638,260 B2
(45) Date of Patent: May 26, 2026

(54) SYSTEMS AND METHODS FOR ENHANCED FIREARM SUPPRESSION

(71) Applicant: North Country Armory, Gillette, WY (US)

(72) Inventors: Nick Ryan Johnson, Gillette, WY (US); Kirt James Jensen, Sheridan, WY (US)

(73) Assignee: North Country Armory, Gillette, WY (US)

( * ) Notice: Subject to any disclaimer, the term of this patent is extended or adjusted under 35 U.S.C. 154(b) by 0 days.

(21) Appl. No.: 19/218,431

(22) Filed: May 26, 2025

(65) Prior Publication Data

US 2025/0362101 A1 Nov. 27, 2025

Related U.S. Application Data

(60) Provisional application No. 63/651,845, filed on May 24, 2024.

(51) Int. Cl.
*F41A 21/30* (2006.01)

(52) U.S. Cl.
CPC ..... *F41A 21/30* (2013.01)

(58) Field of Classification Search
CPC ..... F41A 21/30
USPC ..... 89/14.4; 181/223
See application file for complete search history.

(56) References Cited

U.S. PATENT DOCUMENTS

| | | | | |
|---|---|---|---|---|
| 7,207,258 | B1 * | 4/2007 | Scanlon | F41A 21/30 89/14.4 |
| 11,268,776 | B1 * | 3/2022 | Noonan | F41A 21/30 |
| 2024/0367294 | A1 * | 11/2024 | Geissele | B25B 13/463 |
| 2025/0207883 | A1 * | 6/2025 | Escalier | F41A 21/30 |

* cited by examiner

*Primary Examiner* — Bret Hayes
(74) *Attorney, Agent, or Firm* — FisherBroyles LLP; Russell Manning

(57) ABSTRACT

A firearm suppressor. In an embodiment, the suppressor includes an outer tube and a baffle core disposed within the outer tube. The baffle core includes a body having an exterior surface spaced from the inside surface of the outer tube. A bore extends through the body from an inlet to an outlet permitting a bullet to pass through the baffle core. A plurality of slots or through holes extend through the body between the bore and the external surface of the body permitting gases to expand outward toward the outer tube. A plurality of blind cavities are formed into the external surface of the body and extending into the body without penetrating the bore. These blind cavities provide additional surface area and slow the exit of gases from the suppressor and further cool the gases.

19 Claims, 12 Drawing Sheets

SYSTEMS AND METHODS FOR ENHANCED FIREARM SUPPRESSION

CROSS REFERENCE

The present application claims the benefit of the filing date of U.S. Provisional Application No. 63/651,845 having a filing date of May 24, 2024, the entire contents of which is incorporated herein by reference.

FIELD

This disclosure relates generally to firearms, and in particular to an improved apparatus, system and method for suppressing the sound level of a firearm and reducing pressure at both the muzzle and the shooter's position.

BACKGROUND

Suppressors for firearms function by providing an expansion space for the high-pressure gas generated by the rapid burning of powder behind a fired bullet. This expansion reduces the gas pressure, consequently lowering the sound generated while firing the bullet. Traditionally, suppressors have been built with an outer tube and stacked internal baffling components. The outer tube (e.g., metal) end caps, either welded or threaded in place. When threaded, the suppressor may be disassembled and serviced. The internal baffling components (baffles) are typically a set of flat disks each having a hole through the center thereof with spacers therebetween to create a volume of space (referred to as a baffle chamber) between each set of disks. Other baffles are more complex having cone or funnel shapes. In any arrangement, the baffles redirect and slow the release of the pressurized gases. The delay in the release of the gas allows for the gas to partially cool thereby reducing the volume of gas released and thereby reducing noise/sound.

Due to the complexity of the baffle-type suppressors, efforts have been made to produce what is sometimes termed a mono-core suppressor where a single monolithic core structure includes a plurality of rigidly connected and spaced baffle plates. For example, U.S. Pat. No. 8,171,840 to Kline et al. describes a monolithic core having a plurality of rigidly connected baffle plates. While simpler in design, mono-core suppressors have not gained widespread acceptance as these suppressors have poorer performance in comparison baffle-type suppressors. That is, mono-core suppressors typically do not reduce sound as effectively as baffle-type suppressors.

SUMMARY

The present disclosure relates to an improved system and method for firearm suppression. The novel suppressors described herein provide an improved volume for gas expansion, a mechanism for heat extraction, and a method of delaying the gas from exiting the suppressor assembly, thereby maximizing heat transfer time.

According to the ideal gas law, $pV=nRT$, where p is pressure, V is volume, T is temperature, n is the amount of substance, and R is the ideal gas constant. When the gas expands into the volume of the suppressor, the pressure decreases, reducing sound. Additionally, a suppressor's surface area absorbs heat from the gas, further lowering its pressure and sound, though a typical suppressor cannot mitigate the sonic crack created when the bullet exceeds the speed of sound. However, it has been recognized that performance of a mono-core suppressor may nearly equal the performance of a similarly sized baffle-type suppressor by increasing the internal surface area of the suppressor. That is, by increasing the internal surface area within a mono-core suppressor, more heat may be absorbed from expanding gases further reducing sound levels.

In an embodiment, the suppressor includes an outer tube and a baffle core disposed within the outer tube. The baffle core includes a body having an exterior surface spaced from the inside surface of the outer tube. A bore extends through the body from an inlet to an outlet permitting a bullet to pass through the baffle core. A plurality of slots or through holes extend through the body between the bore and the external surface of the body permitting gases to expand outward toward the outer tube. A plurality of blind cavities are formed into the external surface of the body and extending into the body without penetrating the bore. These blind cavities provide additional surface area and slow the exit of gases from the suppressor and further cool the gases.

In an embodiment, the body of the baffle core includes rows of through holes and rows of blind cavities along the length of the body. In one arrangement, each row of through holes is disposed next to at least one row of blind cavities. In an arrangement, the baffle core includes a plurality of row of through holes and a plurality of rows of blind holes at radially different locations about the periphery of the body.

In an embodiment, the suppressor includes an inner tube disposed within the outer tube. The inner tube is disposed between an inside surface of the outer tube and an outside surface of the baffle core. In an embodiment, gases are permitted to enter into a space between the inner tube and outer tube. The inner tube slows the escape of gas, which is typically at a high temperature, and in turn allows more heat to be absorbed. This improved heat absorption reduces the sound generated by firing the firearm.

The inner tube and/or the outer tube may include a plurality of grooves/fins. These grooves/fins are located along the exterior or interior of the tubes and increase the surface area of the tube, thereby enhancing heat transfer from the gas.

BRIEF DESCRIPTION OF THE DRAWINGS

The accompanying drawings form a part of this disclosure and are incorporated into the specification. The drawings illustrate example embodiments of the disclosure and, in conjunction with the description and claims, serve to explain various principles, features, or aspects of the disclosure. Certain embodiments of the disclosure are described more fully below with reference to the accompanying drawings. However, various aspects of the disclosure may be implemented in many different forms and should not be construed as being limited to the implementations set forth herein.

It should be understood, of course, that the present disclosure is not necessarily limited to the particular embodiments illustrated herein. Additionally, it should be understood that the drawings are not necessarily to scale.

Additional aspects of the system and method are described in greater detail herein.

DETAILED DESCRIPTION

Unless defined otherwise, all technical and scientific terms used herein have the same meaning as is commonly understood by one of ordinary skill in the art. All patents, applications, published applications, and other publications to which reference is made herein are incorporated by reference in their entirety. In the event that there is a plurality of definitions for a term herein, the ordinary meaning of a term prevails unless otherwise stated.

The phrases "at least one," "one or more," and "and/or," as used herein, are open-ended expressions that are both conjunctive and disjunctive in operation. For example, each of the expressions "at least one of A, B and C," "at least one of A, B, or C," "one or more of A, B, and C," "one or more of A, B, or C," and "A, B, and/or C" means A alone, B alone, C alone, A and B together, A and C together, B and C together, or A, B and C together.

Unless otherwise indicated, all numbers expressing quantities, dimensions, conditions, and so forth used in the specification and claims are to be understood as being approximations which may be modified in all instances as required for a particular application of the novel apparatus described herein. Details regarding the present invention in its varying embodiments will now be described, with reference to the drawings accompanying this disclosure.

The present application is directed to a firearm suppressor. In a first embodiment, shown in FIGS. 1-5, a three-piece suppressor is described. In a second embodiment, shown in FIGS. 7-10, a four-piece suppressor is described.

Figure 1:
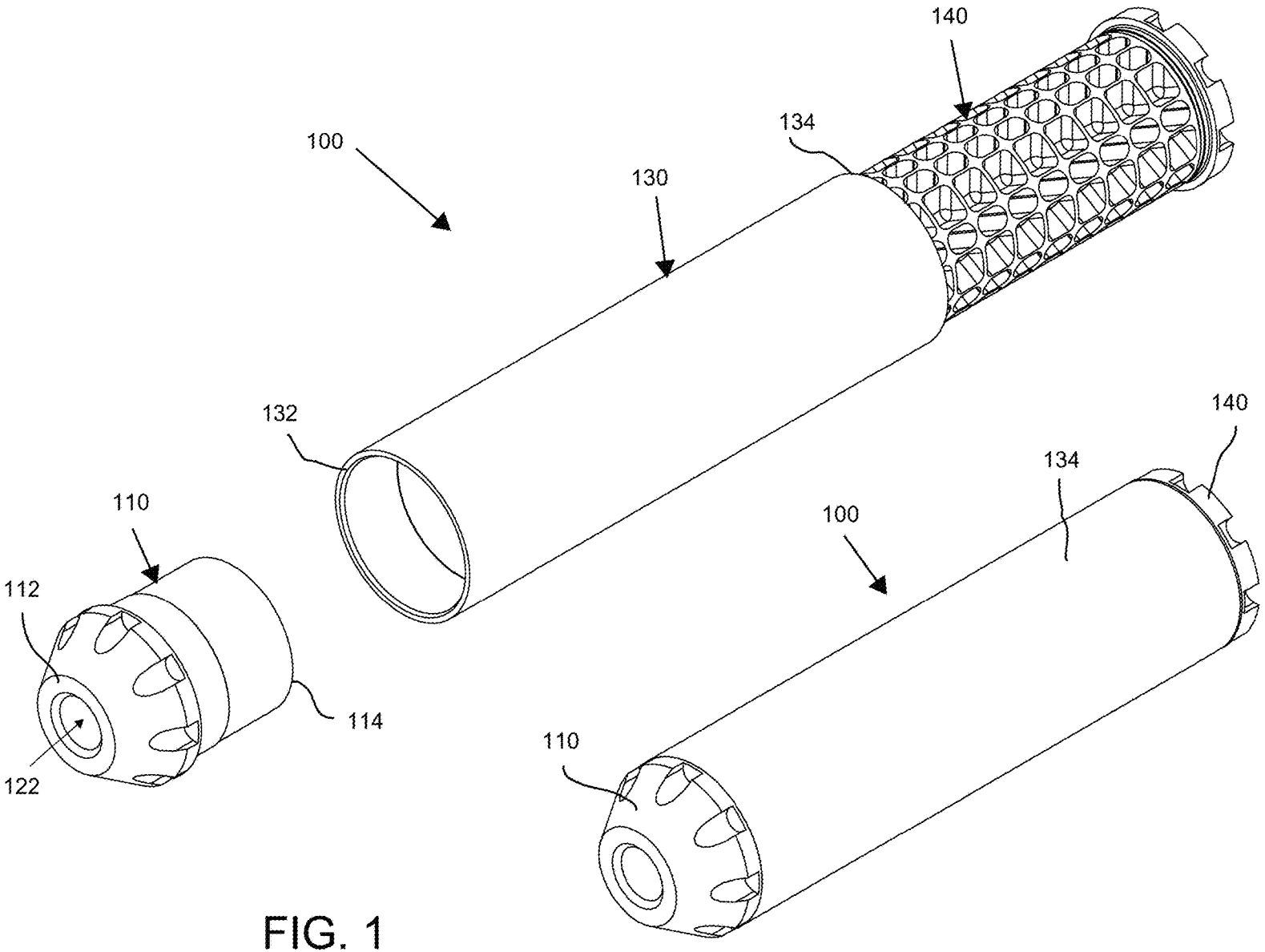
FIG. 1 illustrates perspective and exploded views of a three-piece suppressor, in an embodiment.

Referring to FIG. 1, perspective and exploded perspective views of a three-piece suppressor 100 are illustrated. In this embodiment, the suppressor 100 includes a blast chamber 110, an outer tube 130 and a baffle core 140. An inlet end 112 of the blast chamber 110 is configured for attachment to a firearm (e.g., threaded engagement with a firearm barrel) while an outlet end 114 of the blast chamber 110 is configured for attachment to the baffle core 140. As utilized herein, the term "inlet end" refers to the end of an element through which a bullet fired from a firearm first enters the element. In contrast, the term "outlet end" refers to the end of an element through which the bullet fired from the firearm exits that element. The baffle core 140 is a perforated element having an internal bore through which a bullet fired from a firearm may pass. In addition, the baffle core 140 includes a plurality of openings allowing gas expanding through the bore to expand outwards, as is further discussed herein. The outer tube 130 is configured to surround the baffle core 140 when the suppressor 100 is assembled. The outer tube 130 maintains at least a portion of the expanding gases passing through the perforated baffle core 140 within an internal volume of the suppressor 100. When the gas expands into the volume of the suppressor 100, the pressure of the gas decreases thereby reducing sound. Additionally, the surface area and mass of the suppressor absorbs heat from the gases further lowering pressure of the gases and reducing the resulting sound. As is discussed further herein, the use of the perforated baffle core allows for greatly expanding the available surface area of the suppressor, which results in enhanced sound reduction.

The outer tube 130, in its simplest form, is a hollow tubular structure having a continuous sidewall extending from an inlet end 132 to an outlet end 134. In the illustrated embodiment, the outer tube 130 is a hollow cylindrical element that mates with correspondingly cylindrical elements. However, it will be appreciated that this is not a requirement. That is, aspects of the present disclosure may be incorporated into suppressors having different shapes such as, for example, a rectangular prism.

Figure 2B:
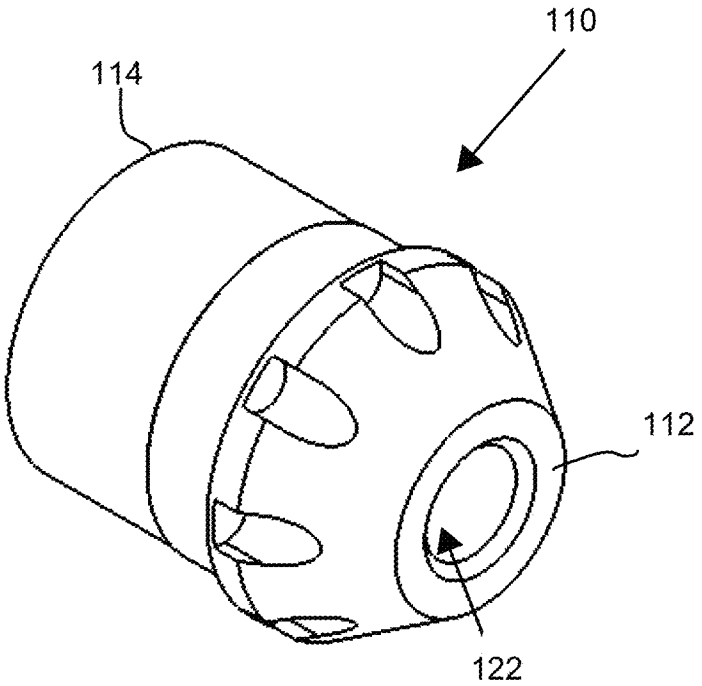
FIGS. 2A and 2B illustrate rear and front perspective views, respectively, of a blast chamber, in an embodiment.
Figure 2A:
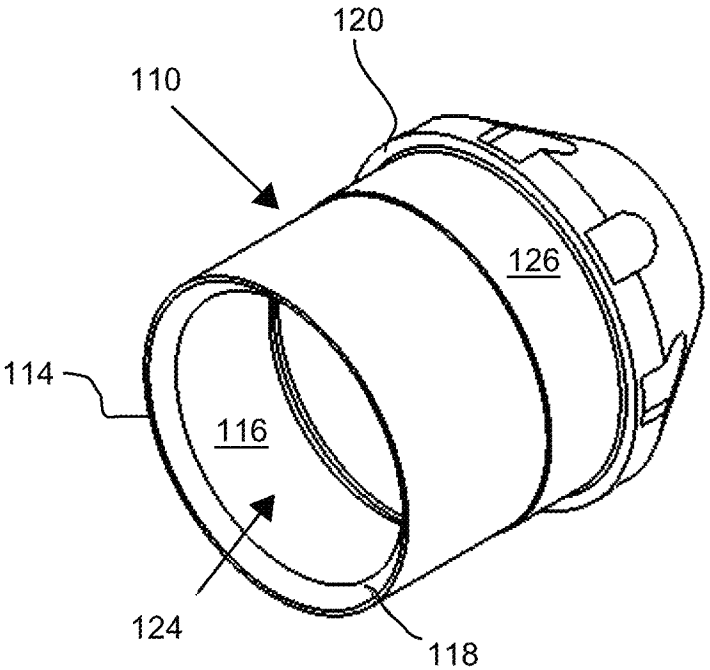

FIGS. 2A and 2B illustrate rear and front perspective views of the blast chamber 110, respectively. As shown, the blast chamber 110 is a generally hollow body having an inlet opening 122 formed in its inlet end 112 and an outlet opening formed 124 in its outlet end 114. Stated otherwise, a continuous sidewall extends from the inlet opening 122 to the outlet opening 124. The inlet opening 122 is configured for attachment to a firearm and an inside surface of the inlet opening 122 may be threaded for connection to a threaded barrel of a firearm. Though discussed as utilizing a threaded engagement between the baffle core and the barrel of the firearm, it will be appreciated that other connection mechanisms (e.g., quick attachment devices) may be utilized and such other attachment mechanisms are within the scope of the present disclosure. The outlet end 114 of the blast chamber 110 is configured to receive an inlet end of the baffle core 140. Accordingly, an inside surface 116 of the inlet opening 124 may be threaded to threadedly engage an inlet end of the baffle core 140. Generally, the inlet opening 112 is considerably smaller than the outlet opening 114. That is, between the inlet end 112 and outlet end 114 of the blast chamber 110, an internal cross-dimension of the blast chamber 110 increases. Stated otherwise, the internal volume of the blast chamber 110 increases over its length allowing gases exiting the barrel of an attached firearm an area into which they may expand.

The blast chamber 110, while being configured for engagement with the baffle core 140, is also configured to engage the outer tube 130, when the suppressor is assembled. In an embodiment, the outer tube 130 may fit over the outside surface of the outlet end 114 of the blast chamber 110. Further, the outer surface of the blast chamber 110 may include a lip 120 of increased cross-dimension extending around its outer periphery that is configured to engage the inlet end 132 of the outer tube 130 when the suppressor 100 is assembled. In addition, the outside surface of the blast chamber 110 may include a ramp section 126 that engages an interior of the inlet end 132 of the outer tube 130 when assembled. This ramp section 126 may help maintain a space between an inside surface of the outer tube 130 and an outside surface of the baffle core 140 when the suppressor 100 is assembled. Of further note, the outlet end 114 of the blast chamber 110 may include a cylindrically tapered surface 118 that may engage a corresponding tapered surface on the baffle core 140 to properly align the baffle core 140 with the blast chamber 110 (e.g., maintain concentricity between the blast chamber and the baffle core). In this regard, bores passing through the blast chamber 110 and the baffle core, which allow allowing a bullet to pass through the suppressor 100, may be more precisely aligned.

Figure 3A:
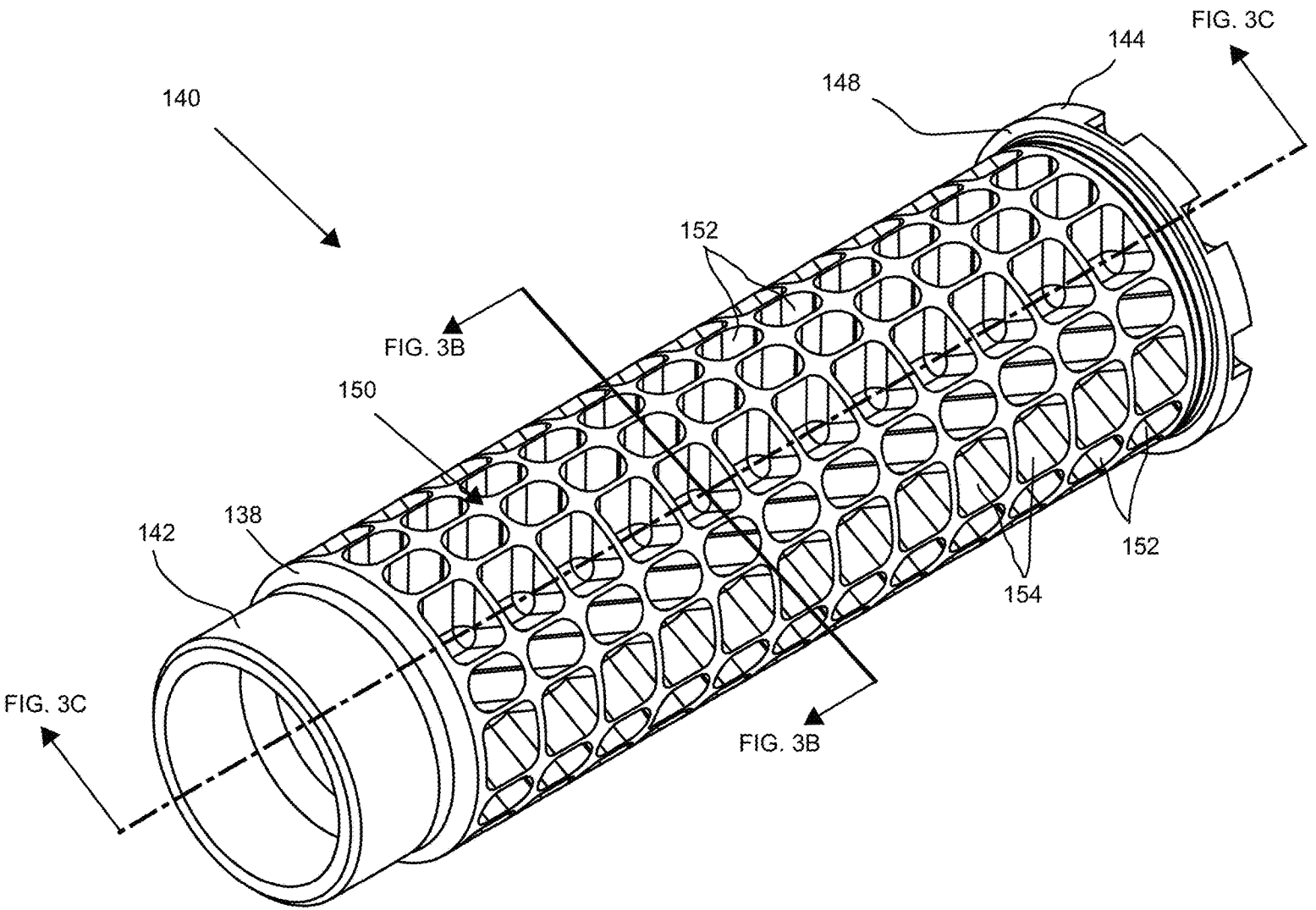
FIG. 3A illustrates a perspective view of a mono-core baffle (e.g., baffle core), in an embodiment.
Figure 3B:
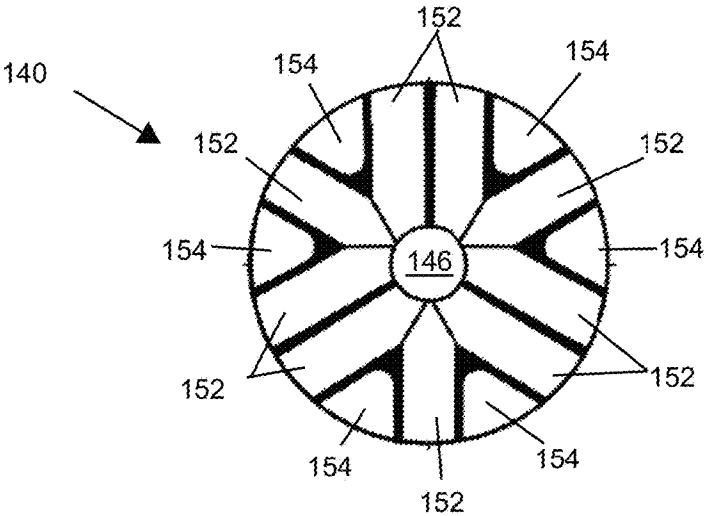
FIG. 3B illustrates a cross-sectional view of the mono-core baffle of FIG. 3A, in an embodiment.
Figure 3C:
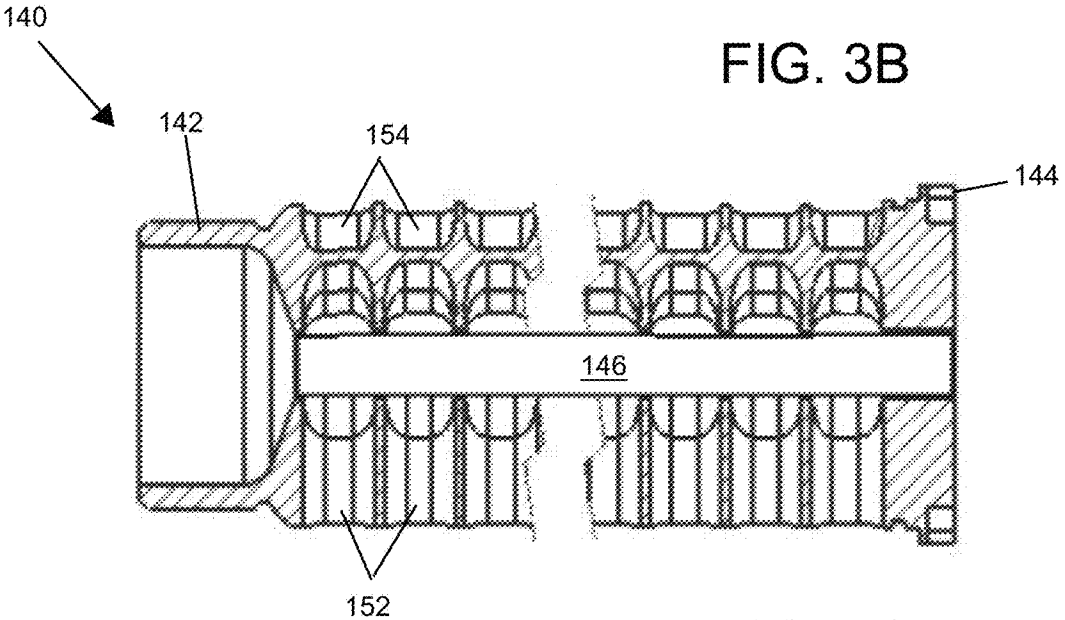
FIG. 3C illustrates a cross-sectional view of the mono-core baffle of FIG. 3A, in an embodiment.

FIGS. 3A, 3B and 3C illustrate the baffle core 140, in an embodiment. In the illustrated embodiment, the baffle core 140 is a generally cylindrical element. However, as noted above, this is not a requirement. The baffle core 140 includes a connection collar 142 attached to an inlet end of a perforated body 150 and a flange 144 connected to an outlet end of the perforated body 150. An internal bore 146 extends through the perforated body 150 between its inlet and outlet ends. See, e.g., FIG. 3C. The size of the bore 146 is selected to permit passage of a bullet of the selected caliber. As will be appreciated, the bore 146 is slightly larger than the caliber of the bullet such that the baffle core 140 does not interfere with passage of the bullet through the suppressor. Formed though the body 150 are a plurality of slots or through holes 152. The through holes 152 extend from the bore 146 to an exterior surface 148 of the body 150. That is, an open inlet end of each of the through holes 152 opens to the bore 146 and passes through the body 150 of the baffle core 140 where each through hole 152 opens on the exterior surface 148 of the body 150 of the baffle core 140. The through holes 152 allow gas to expand through the baffle core 140 when a bullet passes through the suppressor and increasing contact surface area of the suppressor. The body 150 of the baffle core 140 also includes a plurality of blind cavities 154 formed in its exterior surface. These cavities 154 are referred to as blind cavities as they form recesses in the body 150 but do not penetrate through the body to the bore 146. These blind cavities 154 provide additional volume and surface area into which gases may expand. Furthermore, the closed end construction of the blind cavities provide structure that slows the expanding gases, which enhances the heat transfer time between the gases and the mass of the baffle core 140. That is, the cavities provide extensional expansion areas, increase surface area for gas cooling and slow gas escape all of which enhance the effectiveness of the suppressor.

In the illustrated embodiment, the baffle core 140 includes a plurality of rows of slots or through holes 152 and a plurality of rows of blind cavities 154. As illustrated, the present embodiment includes three sets of double rows of through holes 152 and three rows of single holes 152. Additionally, this embodiment includes six rows of blind cavities 154 interposed between each adjacent set of double rows and single rows of through holes 152. The embodiment of providing alternating slots and cavities also strengthens the baffle core 140, allowing it to withstand the pressure and heat without failing, thereby increasing the usable life of the suppressor. However, it will be appreciated that this configuration, while effective in enhancing surface area of the baffle core 140 is presented by way of illustration and not by way of limitation. That is, any variation of through holes and blind cavities may be utilized. However, the outlet opening of each through hole will typically be adjacent to at least one blind cavity, though this is not a strict requirement. Furthermore, each of the through holes is illustrated as an elongated slot and these elongated slots are formed in uniform rows. However, it will be appreciated that other configurations are possible (e.g., circular holes) disposed in nonuniform locations about the periphery of the baffle core 140. In any embodiment, the baffle core 140 will include a plurality of through holes 152 and blind cavities 154 to enhance the overall surface area of the baffle core 140 while providing blind ended cavities that, in addition to increasing surface area while, also slow the expanding gases.

As noted above, an inlet of the baffle core 140 includes an attachment collar 142, which is configured to engage the outlet end 114 of the blast chamber 110. In an embodiment, an outside surface of the attachment collar 142 may be threaded to engage mating threads within the interior of the blast chamber 110. A cylindrically tapered surface 138, which transitions between the base of the attachment collar 142 and the body 150, is configured to engage the corresponding tapered surface 118 of the blast chamber 110 to properly align the baffle core 140 with the blast chamber 110. The attachment collar 142 is a substantially hollow element that forms an interior cavity when attached to the blast chamber 100, which provides additional interior volume for the suppressor allowing additional expansion of gases. The flange 144 attached to the outlet end of the baffle core 140 has an increased cross dimension (e.g., diameter) relative to the body of the baffle core 140 forming a lip 148 configured to engage the outlet end 134 of the outer tube 130, when the suppressor is assembled.

Figure 4:
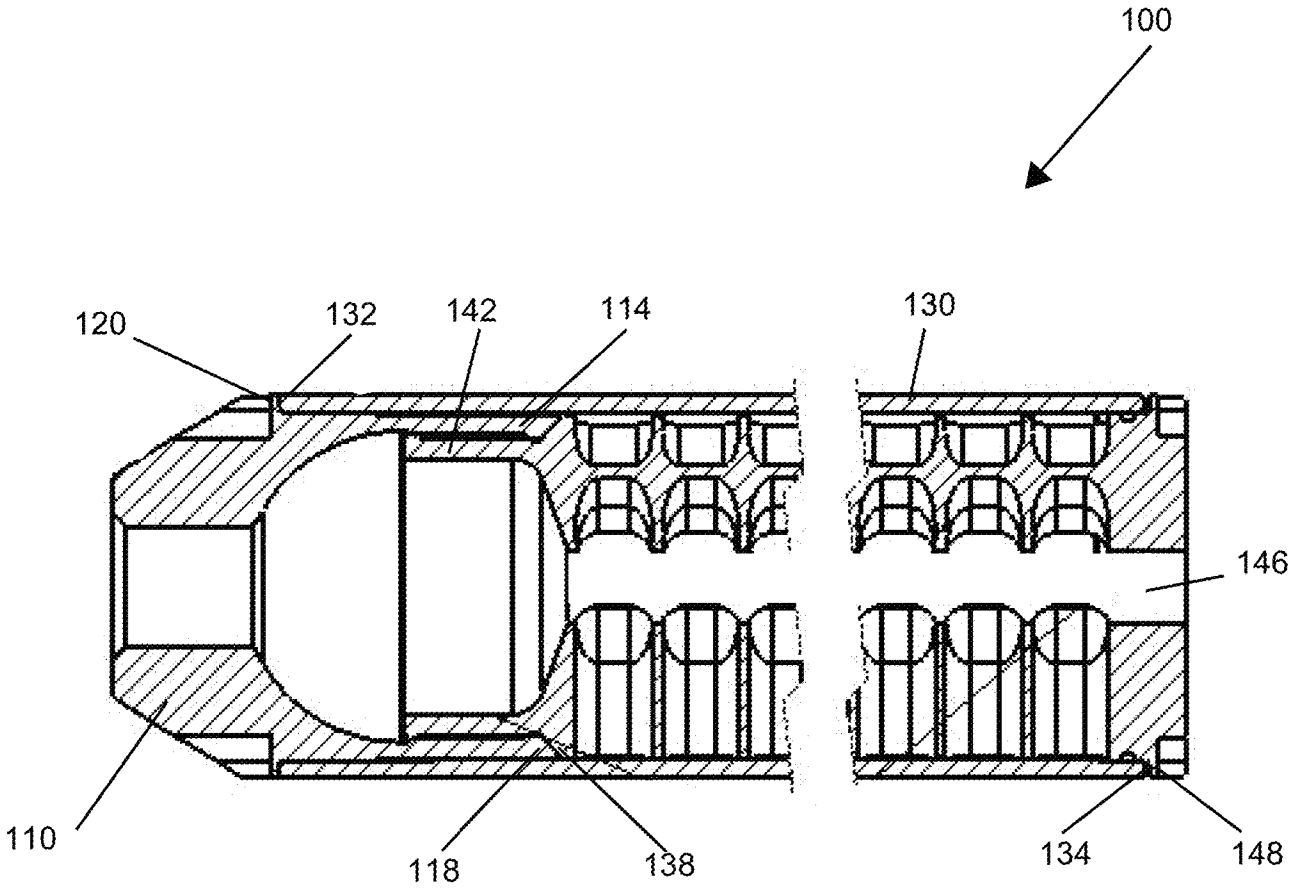
FIG. 4 illustrates a cross-sectional side view of the three-piece suppressor of FIG. 1, in an embodiment.

FIG. 4 is a cross-sectional view taken along a long axis of the suppressor 100 showing the engagement of the various components. As illustrated, the attachment collar 142 is threadedly engaged within the outlet end 114 of the blast chamber 110. Once seated, the cylindrically tapered surface 138 of the baffle core 140 is seated against the cylindrically tapered surface 118 of the blast chamber 110. In addition, the inlet end 132 of the outer tube 130 abuts against the lip 120 formed around the outside surface of the blast chamber 110. Likewise, the outlet end 134 of the outer tube 130 abuts against the lip 148 formed on the flange 144 on the outlet end of the baffle core 140. Stated otherwise, when the baffle core 140 is threadedly engaged with the blast chamber 110, the outer tube 130 is securely affixed between the lip 120 on the blast chamber 110 and the lip 148 on the baffle core 140 holding the outer tube 130 in its proper location. Along these lines, an inside surface of the outer tube 130 is slightly spaced from an outside surface of the baffle core 140. This spacing allows gases passing through the through holes 152 of the baffle core 140 to expand outward and around a portion of the periphery of the baffle core 140 where these gases may become partially entrapped within the blind cavities 154.

Figure 5:
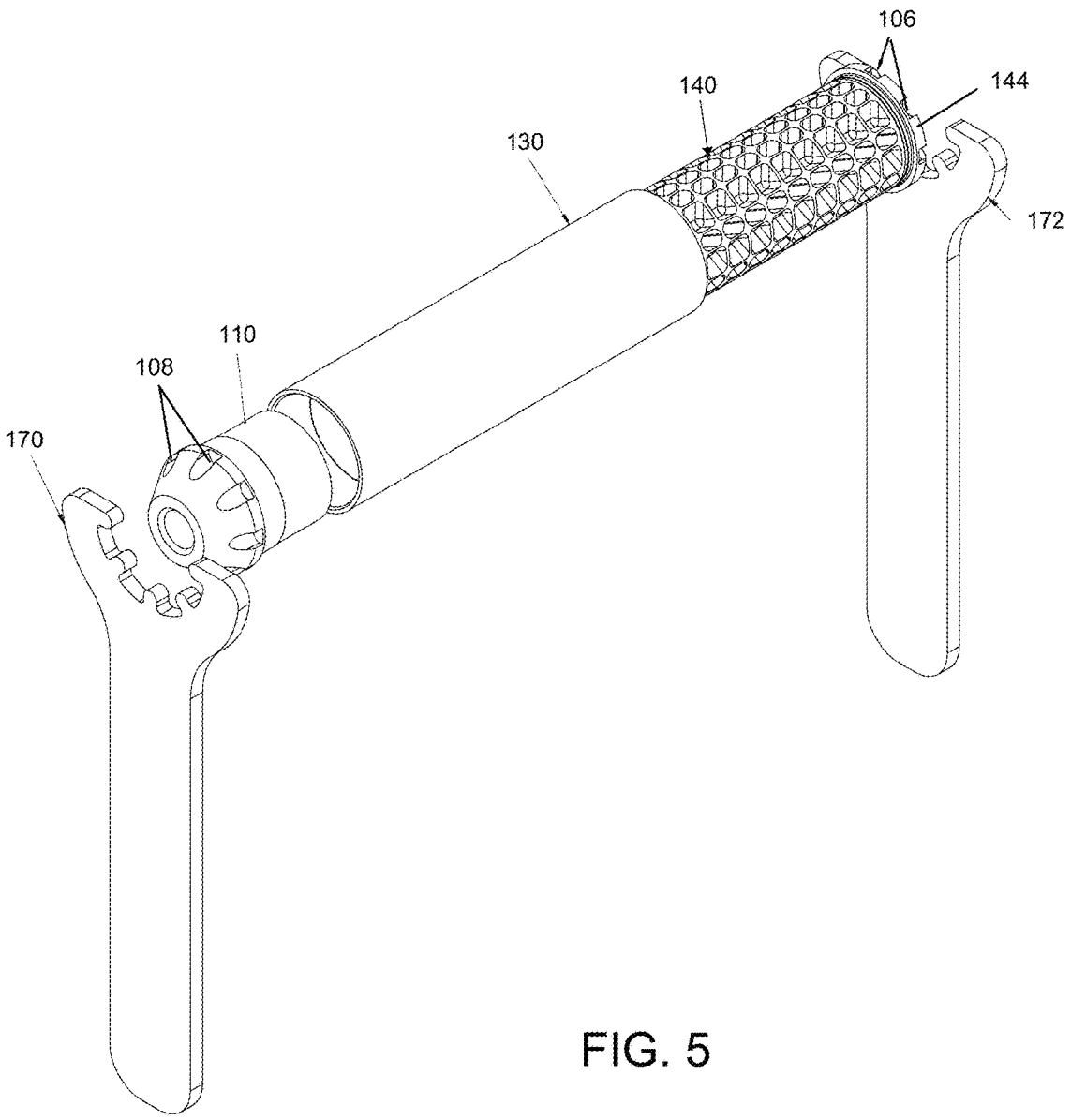
FIG. 5 illustrates assembly of the three-piece suppressor, in an embodiment.

FIG. 5 illustrates the assembly or disassembly of the suppressor 100. As noted above, the suppressor 100 is assembled, in an embodiment, by threading the baffle core 40 to the blast chamber 110. Such engagement allows the suppressor 100 to be assembled and disassembled as needed for cleaning. In the present embodiment, an outer surface of the inlet end of the blast chamber 110 includes a plurality of 108 notches spaced about its outside periphery that are configured to receive the teeth of a spanner wrench 170. Likewise, the flange 144 formed on the outlet end of the baffle core 140 may likewise include a plurality of notches 106 configured to receive the teeth of a second spanner wrench 172. This configuration allows the suppressor 100 to be easily assembled and disassembled to allow for periodic cleaning. Other assembly and disassembly configurations are possible.

Figure 6:
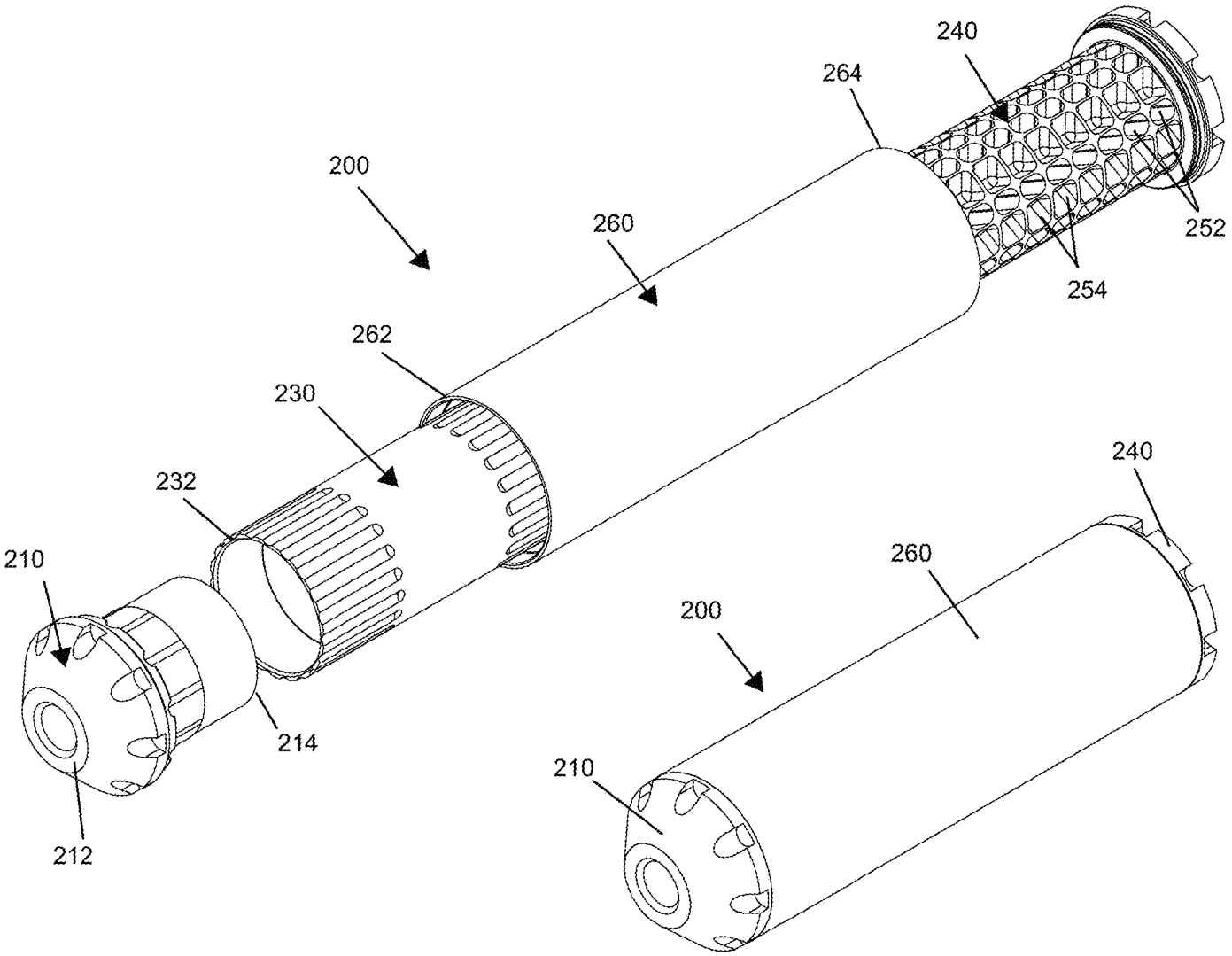
FIG. 6 illustrates perspective and exploded views of a four-piece suppressor, in an embodiment.

FIG. 6 illustrates perspective and exploded perspective views of a four-piece suppressor 200. In this embodiment, the suppressor 200 includes a blast chamber 210, an inner tube 230, an outer tube 260 and a baffle core 240. An inlet end 212 of the blast chamber 210 is configured for attachment to a firearm (e.g., threaded engagement with a firearm barrel) while an outlet end 214 of the blast chamber 210 is configured for attachment to the baffle core 240. The baffle core 240 is substantially similar to the baffle core 140 described above in FIGS. 3A-3C having a central bore, through holes 252 and blind cavities 254. The inner tube 230 surrounds and is spaced from an outside surface of baffle core 240. The outer tube 260 surrounds and is spaced from the inner tube 230. The inclusion of the inner tube 230 and outer tube 260 further increases the surface area of the suppressor 200 and further slows the escape of gases from the suppressor allowing more heat absorption and further reducing sound. That is, the suppressor 200 preferably provides sufficient volume for gas expansion, a mechanism for heat extraction, and a way to slow the exit of gas from the firearm to maximize heat transfer time. The inner tube 230, which is positioned between the outer tube 260 and the baffle core 240, slows the escape of hot gas created from firing the firearm, allowing more heat to be absorbed and thereby reducing sound.

Figure 7:
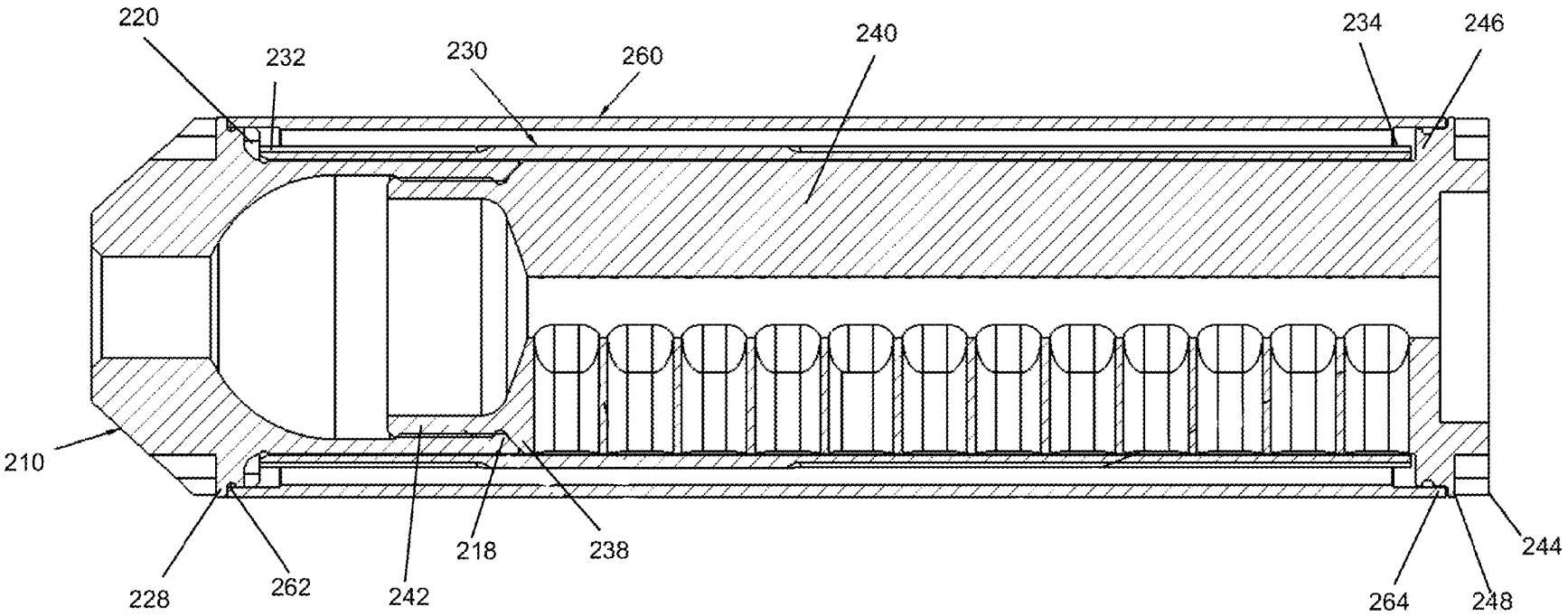
FIG. 7 illustrates a cross-sectional side view of the four-piece suppressor of FIG. 6, in an embodiment.

FIG. 7 is a cross-sectional view taken along a long axis of the suppressor 200 showing the engagement of the various components. As illustrated, an attachment collar 242 of the baffle core 240 is threadedly engaged within the outlet end of the blast chamber 210. Once seated, a cylindrically tapered surface 238 of the baffle core 240 is seated against a cylindrically tapered surface 218 of the blast chamber 210. An inlet end 232 of the inner tube 230 abuts against a first lip 220 formed around the outside surface of the blast chamber 210 while an outlet end 234 of the inner tube 230 abuts against a first lip 246 formed around a flange 244 on the outlet end of the baffle core 240. Likewise, an inlet end 262 of the outer tube 260 abuts against a second lip 228 formed around the outside surface of the blast chamber 210 while an outlet end 264 of the outer tube 260 abuts against a second lip 248 formed around the flange 244 on the outlet end of the baffle core 240. When the baffle core 240 is threadedly engaged with the blast chamber 210, the inner and outer tubes 230, 260 are securely affixed between the lips on the blast chamber 210 and the baffle core 240 holding the inner and outer tubes 230, 260 in their proper locations with the inside surface of the outer tube 260 spaced from the outside surface of the inner tube 230.

Figure 8B:
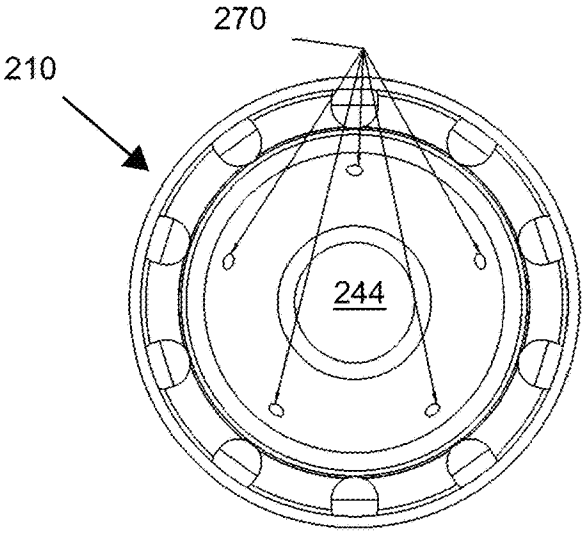
FIGS. 8A and 8B illustrate rear perspective and end views, respectively, of a blast chamber, in an embodiment.
Figure 8A:
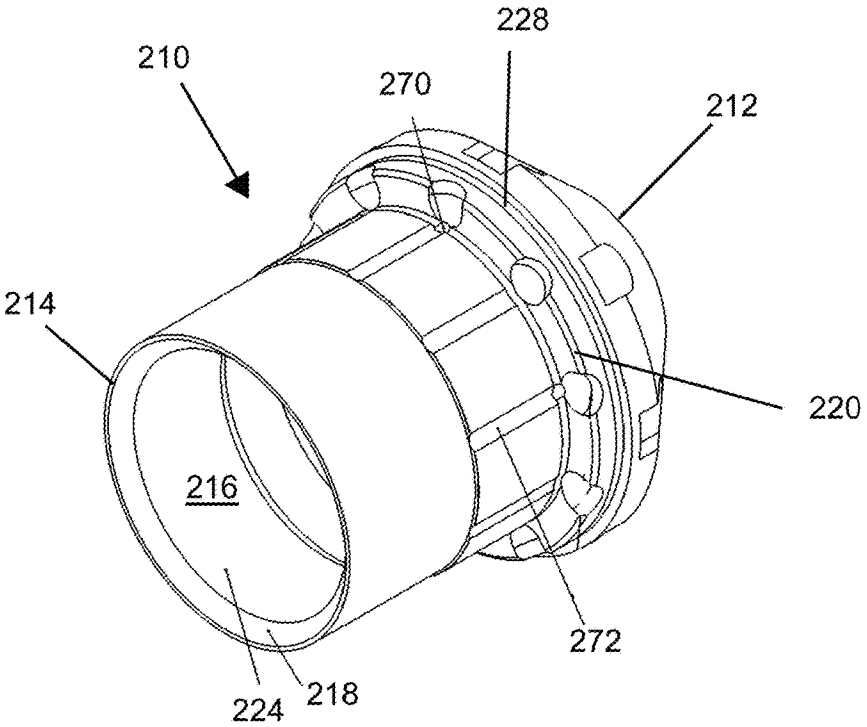

FIGS. 8A and 8B illustrate rear perspective and rear end views, respectively, of the blast chamber 210. As with the embodiment of FIGS. 2A and 2B, the blast chamber 210 is a generally hollow body having an inlet opening 222 formed in its inlet end 212 and an outlet opening formed 224 in its outlet end 214. The inlet opening 222 is configured for attachment to a firearm and an inside surface of the inlet opening 222 may be threaded for connection to a threaded barrel of a firearm. Though discussed as utilizing a threaded engagement between the baffle core and the barrel of the firearm, it will be appreciated that other connection mechanisms (e.g., quick attachment devices) may be utilized and such other attachment mechanisms are within the scope of the present disclosure. The outlet end 214 of the blast chamber 110 is configured to receive an inlet end of the baffle core 240. Accordingly, an inside surface 216 of the inlet opening 224 may be threaded to threadedly engage an inlet end of the baffle core 240.

To utilize the additional surface area and volume provided by the space between the inner tube 230 and the outer tube 260, gases must be allowed to expand into this space. To permit this expansion, the blast chamber 210 includes a plurality of gas passage ports 270 extending through its sidewall. As illustrated, the gas passage ports 270 may be disposed at spaced location around the periphery of the blast chamber. The gas passage ports 270 open on the outside surface of the blast chamber 210 between the first lip 220 and the second lip 228, which position the inner tube 230 and the outer tube 260, respectively. When the suppressor is assembled, the gas passage ports 270 permit gases within the interior of the blast chamber 210 to expand into the space between the inner tube 230 and the outer tube 260. To further facilitate passage of gas through the gas passage ports 270, each gas passage port 270 may open into a gas flow slot 272 that is positioned within the interior of the inner tube 230 when the suppressor is assembled.

Figure 9:
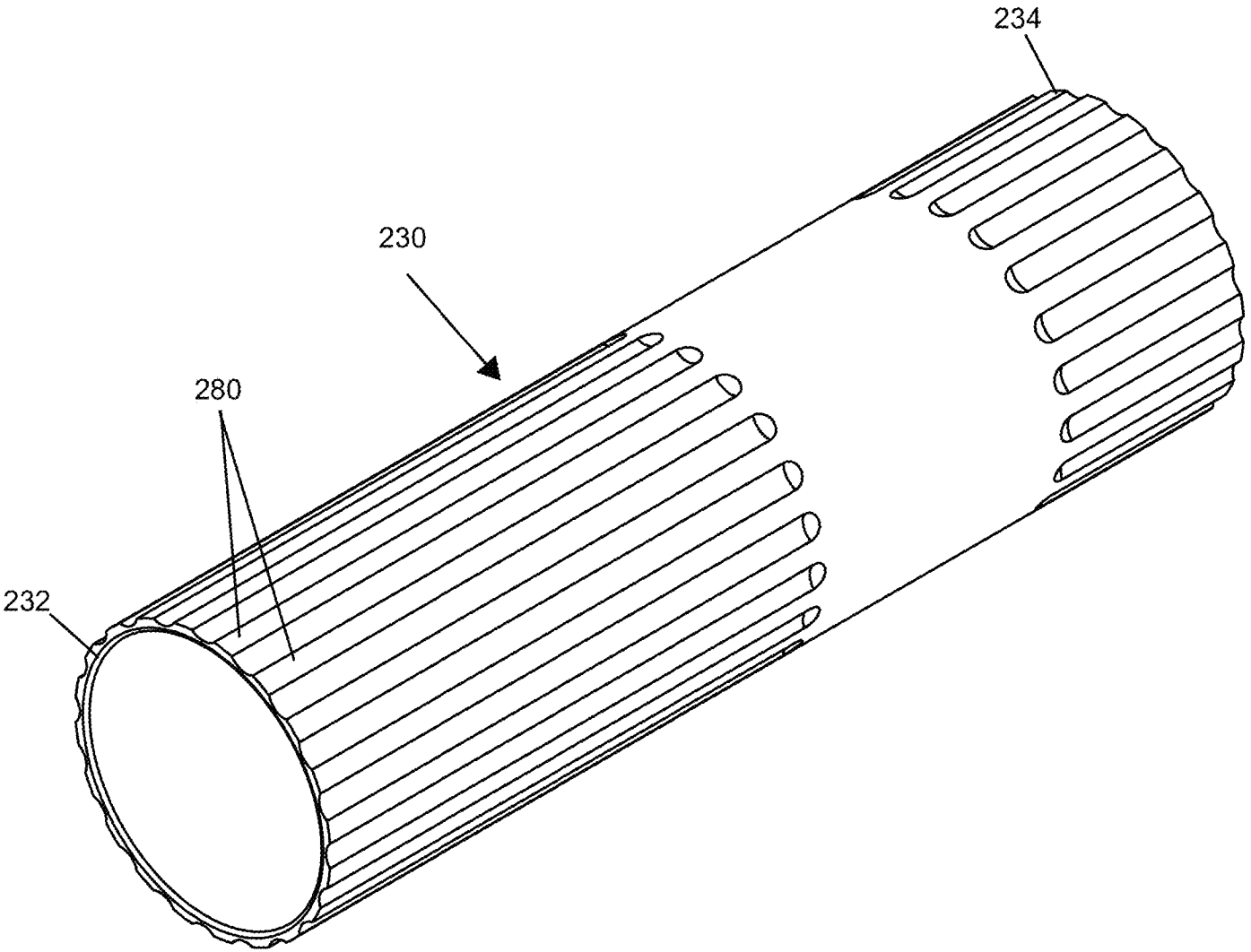
FIG. 9 illustrates a perspective view of an inner tube, in an embodiment.
Figure 10:
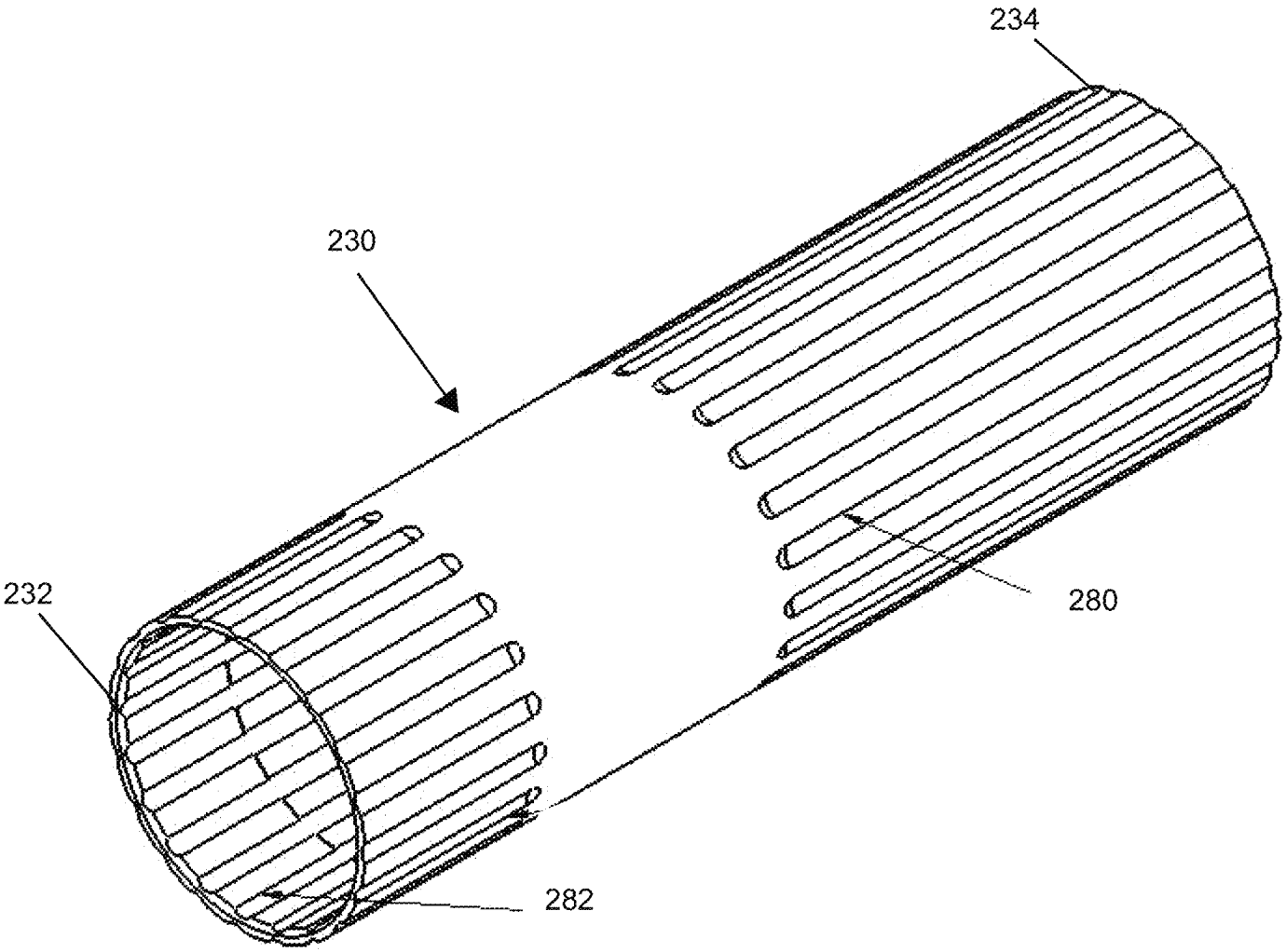
FIG. 10 illustrates a perspective view of another inner tube, in an embodiment.
Figure 11:
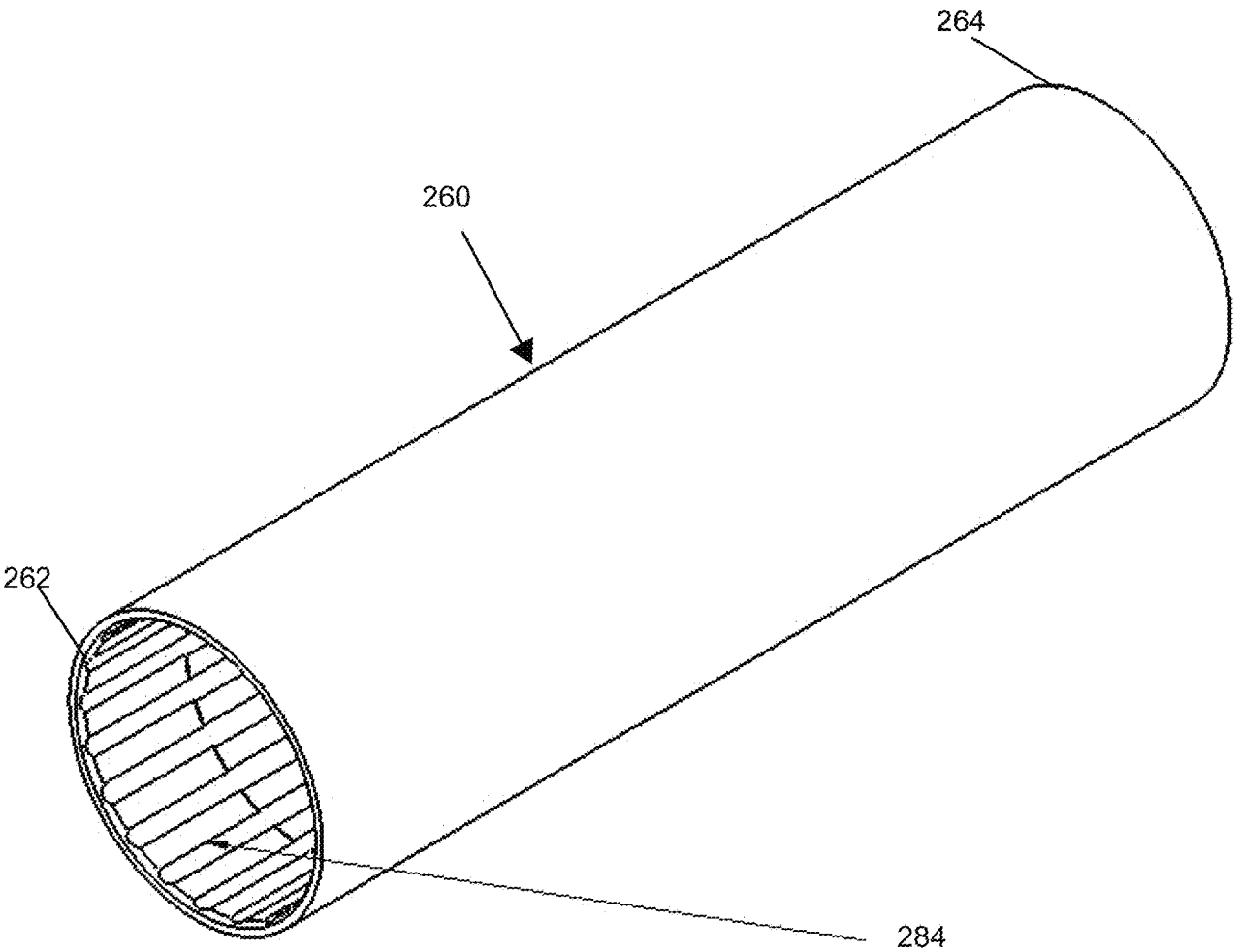
FIG. 11 illustrates a perspective view of an outer tube, in an embodiment.

As illustrated in FIGS. 9 and 10, the inner tube may be further configured to include additional heat transferring surfaces that increase its overall surface area. As shown in FIG. 9, the inner tube 230 may include a plurality of grooves/fins 280 formed over a portion or an entirety of its exterior surface. As shown in FIG. 10, the inner tube 230 may include both interior grooves/fins 282 and exterior grooves/fins 280. Alternatively, the inner tube 230 the outer tube may include no grooves/fins at all. As shown in FIG. 11, the outer tube 260 may also include a plurality of grooves/fins 284 formed over a portion or an entirety of its interior surface. In any of these embodiments, the grooves/fins on the inner and/or exterior surfaces of the inner tube 230 and/or outer tube 260 increase the surface area of the suppressor enhancing heat transfer from the gas. It is expressly understood that the suppressor may include different combinations of inner and/or outer tubes having grooves/fins in only one area of the tube, on only an external surface, on only an internal surface, or on both the internal and external surfaces of the respective tubes. In addition, the number and/or spacing of grooves/fins may vary from that depicted in FIGS. 9-11.

The disclosed suppressors, in their primary embodiment, utilize a monolithic baffle core (e.g., mono-core), which simplifies assembly and disassembly of the suppressor. Further, extensive testing has shown that the presented monolithic baffle core design results in suppression that is similar to suppression of more traditional suppressors built with an outer tube and stacked internal baffling components (e.g., stacked disks; flat or contoured). For instance, one commercially available traditional suppressor is the SliencerCO Omega 300. This silencer has a length of approximately 7 inches and a diameter of approximately 1.6 inches. When used on a 308-caliber bolt action rifle, the SliencerCO Omega 300 suppressor reduces sound from an unsuppressed sound level of approximately 150.4 decibels to approximately 129.4 decibels. A three-piece suppressor in accordance with the present disclosure having a length of approximately 6.2 inches and a diameter of approximately 1.5 inches, used on the same 308 caliber bolt action rifle, reduces sound from an unsuppressed sound level of approximately 150.4 decibels to approximately 133.3 decibels. A four-piece suppressor in accordance with the present disclosure having a length of approximately 8.4 inches and a diameter of approximately 1.75 inches, used on the same 308 caliber bolt action rifle, reduces sound from an unsuppressed sound level of approximately 150.4 decibels to 126.8 decibels. Based on this testing, it has been determined that sound suppression that meets or exceeds traditional suppressors may be achieved using the disclosed monolithic baffle core. However, while the suppressor is primarily contemplated as having a monolithic baffle core, it will be appreciated that aspects of the present disclosure may be incorporated into a baffle core having multiple mating parts.

The ability to suppress sound using the disclosed monolithic baffle core is due in part to the greatly increased surface area generated using the pass through holes/slot and blind cavities. That is, the surface area incorporated into the volume of the suppressor allows for significant temperature reduction in the expanding gases resulting in reduced sound. In relation to the above noted three-piece suppressor having a length of approximately 6.2 inches and a diameter of approximately 1.5 inches, the internal volume was found to be approximately 7.6 cubic inches with an internal surface area of approximately 100 square inches. In relation to the above noted four-piece suppressor having a length of approximately 8.4 inches and a diameter of approximately 1.75 inches, the internal volume was found to be approximately 11 cubic inches with an internal surface area of approximately 220 square inches. In both instances, the ratio of the internal surface area to volume is over 18. It is believed a monolithic core suppressor having a ratio of internal surface area to volume of over 14 will provide suppression approximating conventional suppressors, in an embodiment. In a further embodiment, the ratio of internal surface area to volume of may exceed 16. In a yet further embodiment, the ratio of internal surface area to volume of may exceed 18.

The length and/or diameter of the components described above, particularly the inner and outer tubes and baffle core, may be planned for a specific firearm. Therefore, it is contemplated that the aspect ratios between the length and diameter may differ than those in the appended drawing figures. One having skill in the art will appreciate that embodiments of the present disclosure may have various sizes, including, for example, width, length and thickness, and the size of the components.

Components of the system may be constructed of materials known to provide or predictably manufactured to provide the various aspects of the present disclosure. These materials may include, for example, steel, stainless steel, titanium alloy, aluminum alloy, chromium alloy, and other metals or metal alloys. Other component materials may include, for example, carbon fiber, ceramics, and derivatives thereof. One or more of the components described herein may be manufactured via additive manufacturing, machining and/or milling.

Additional components may also be provided depending on the specific firearm in use with the invention as would be expected by those of ordinary skill in the art. While various embodiments of the present disclosure have been described in detail, it is apparent that modifications and alterations of those embodiments will occur to those skilled in the art. However, it is to be expressly understood that such modifications and alterations are within the scope and spirit of the present disclosure. Any patent, publication, or other disclosure material, in whole or in part, which is said to be incorporated by reference herein is incorporated herein only to the extent that the incorporated materials does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

What is claimed is:

1. A firearm suppressor, comprising:

a tube;

a baffle core disposed within the tube, the baffle core including:

a body, wherein an external surface of the body is spaced from an internal surface of the tube;

a bore extending through the body from an inlet opening to an outlet opening;

a plurality of through holes extending through the body between the bore and the external surface of the body; and a plurality of blind cavities formed into the external surface of the body and extending into the body without penetrating the bore.

2. The suppressor of claim 1, wherein the plurality of through holes comprises at least a first row of through holes formed along a length of the body.

3. The suppressor of claim 2, further comprising at least two sets of rows of through holes located at different radial locations along the length of the body relative to a long axis of the bore.

4. The suppressor of claim 2, wherein the plurality of blind cavities comprises at least a first row of blind holed formed along the length of the body.

5. The suppressor of claim 4, further comprising at least two sets of rows of blind cavities located at different radial locations along the body relative to a long axis of the bore.

6. The suppressor of claim 4, wherein a first row of blind cavities formed along the length of the body is disposed between first and second rows of through holes formed along the length of the body.

7. The suppressor of claim 1, wherein an open end of each of the plurality of through holes on the exterior surface of the body is adjacent to at least one blind cavity.

8. The suppressor of claim 1, further comprising a blast chamber configured to connect to an inlet end of the baffle core.

9. The suppressor of claim 8, wherein the blast chamber is a hollow element having an annular sidewall extending between an inlet opening and an outlet opening, wherein the inlet opening is configured for attachment to firearm and an outlet opening is configured to connect to the baffle core, wherein the outlet opening is larger than the inlet opening.

10. The suppressor of claim 8, wherein the tube is disposed between the blast chamber and a flange on an outlet end of the baffle core.

11. The suppressor of claim 1, wherein the is an inner tube and further comprising an outer tube disposed around the inner tube, wherein an inside surface of the outer tube is spaced from an outside surface of the inner tube.

12. The suppressor of claim 11, wherein one of:

the inner tube comprises a plurality of grooves formed on its outside surface;

the inner tube comprises a plurality of grooves formed on its inside surface;

the outer tube comprises a plurality of grooves formed on its inside surface.

13. The suppressor of claim 12, further comprising a blast chamber configured to connect to an inlet end of the baffle core, wherein the blast chamber is a hollow element having an annular sidewall extending between an inlet opening and an outlet opening, wherein the inlet opening is configured for attachment to firearm and an outlet opening is configured to connect to the baffle core, wherein the outlet opening is larger than the inlet opening.

14. The suppressor of claim 13, wherein the blast chamber comprises at least one port fluidly connecting an interior of the blast chamber to a space between the inner tube and the outer tube.

15. The suppressor of claim 1, wherein a ratio of an internal surface area to an internal volume exceeds 14.

16. A method for suppressing sounds generated by the discharge of a firearm generating propellant gases, comprising:

receiving a bullet through an inlet end of a suppressor, wherein the suppressor includes a hollow blast chamber attached to a baffle core, and an outer tube, wherein the baffle core has a body having a bore therethrough;

expanding the propellant gases through a plurality of through holes extending through the body of the baffle core from the bore to an external surface of the baffle core spaced from an inside surface of the outer tube; and expanding the propellant gases exiting the plurality of through holes on the external surface of the baffle core into blind cavities formed into the external surface of the body and extending into the body without penetrating the bore.

17. The method of claim 16, further comprising at least partially blocking the expanding gasses expanding through the through holes within the suppressor using an outer tube disposed around the baffle core.

18. The method of claim 17, further comprising disposing an inner tube between the outer tube and the baffle core, wherein expanding the propellant gases includes expanding the gases into a space between the inner tube and the outer tube.

19. The method of claim 18, wherein the propellant gases are ported through passages in the blast chamber onto the space between the inner tube and outer tube.

* * * * *